US005967222A

United States Patent [19]

Musschoot et al.

[11] Patent Number: 5,967,222

[45] **Date of Patent: *Oct. 19, 1999**

[54] VIBRATORY SAND RECLAMATION SYSTEM

[75] Inventors: Albert Musschoot, Barrington Hills; Daniel T. Lease, McHenry, both of Ill.

[73] Assignee: General Kinematics Corporation, Barrington, Ill.

[ * ] Notice: This patent is subject to a terminal disclaimer.

[21] Appl. No.: 08/844,738

[22] Filed: Apr. 21, 1997

Related U.S. Application Data

[63] Continuation of application No. 08/770,343, Dec. 20, 1996, Pat. No. 5,924,473.

[51] Int. Cl.[6] ..... B22D 29/00

[52] U.S. Cl. ..... 164/404; 164/5; 266/252

[58] Field of Search ..... 164/404, 401, 164/5, 131, 132; 266/251, 252, 257; 148/710

[56] References Cited

U.S. PATENT DOCUMENTS

| | | | |
|---|---|---|---|
| Re. 33,542 | 2/1991 | Musschoot . | |
| 1,789,860 | 1/1931 | Bennington . | |
| 2,385,962 | 10/1945 | Barnett | 84/18 |
| 2,813,318 | 11/1957 | Horth . | |
| 2,821,375 | 1/1958 | Andrews . | |
| 2,856,273 | 10/1958 | Beber et al. . | |
| 2,988,351 | 6/1961 | Barnett et al. . | |

(List continued on next page.)

FOREIGN PATENT DOCUMENTS

| | | |
|---|---|---|
| 1 197 981 | 12/1985 | Canada . |
| 0 546 210 | 6/1993 | European Pat. Off. . |
| 2 315 958 | 4/1974 | Germany . |
| 2 337 894 | 11/1974 | Germany . |

(List continued on next page.)

OTHER PUBLICATIONS

CEC Consolidated Engineering Company, "Quality Heat Processing Equipment: Furnaces Ovens Dryers Washers Systems," Consolidated Engineering Company, Kennesaw, Georgia, pp. 1–15.

Dr. Károly Erdész, "Vibrational Thermal Processing Equipment—Design and Appllication," Hungary (1995).

General Kinematics, "General Kinematics Innovations—Resourceful answers to process and material handling needs through creative engineering", Bulletin 586R, General Kinematics Corporation, Barrington, Illinois, pp. 1–10 (1986).

Kogyo–Kanetsu, "Economical Used Energy Type, Continuing Heat Treating Furnaces for Aluminum Castings," pp. 1–17 Published Mar. 1984.

Paul M. Crafton, "Heat Treating, Aging System also Permits Core Sand Removal," Reprinted from Sep. 1989 Modern Casting Magazine, Consolidated Engineering Co., Kennesaw, GA.

(List continued on next page.)

*Primary Examiner*—J. Reed Batten, Jr.

*Attorney, Agent, or Firm*—Marshall, O'Toole, Gerstein, Murray & Borun

[57] ABSTRACT

In order to effectively remove and reclaim sand from a metal casting, an apparatus and system includes a bed having an entrance for receiving the casting and an exit for removing the casting. The bed is adapted to fluidize sand and may also be subjected to vibratory forces. The apparatus and system further includes a sand distribution conveyor for supplying sand to be fluidized to the bed at a point generally near the entrance and a sand transfer conveyor for removing sand to be recirculated from the bed at a point generally near the exit. The bed achieves a thorough mixing of the sand due to the fluidization and vibratory forces. With these features of construction, the apparatus and system also includes a sand return conveyor with all of the conveyors being vibratory and insulated to achieve energy efficient sand recirculation.

16 Claims, 4 Drawing Sheets

U.S. PATENT DOCUMENTS

| | | | |
|---|---|---|---|
| 3,053,704 | 9/1962 | Munday . | |
| 3,534,946 | 10/1970 | Westerkamp et al. . | |
| 3,607,071 | 9/1971 | Staffin et al. . | |
| 3,676,647 | 7/1972 | Staffin et al. . | |
| 3,677,404 | 7/1972 | Staffin et al. . | |
| 3,737,280 | 6/1973 | Cromp | 432/41 |
| 3,760,800 | 9/1973 | Staffin et al. . | |
| 3,871,438 | 3/1975 | Vissers et al. | 164/5 |
| 3,989,227 | 11/1976 | Musschoot . | |
| 4,068,389 | 1/1978 | Staffin et al. | 34/57 |
| 4,140,467 | 2/1979 | Ellison et al. | 432/72 |
| 4,161,389 | 7/1979 | Staffin et al. | 432/58 |
| 4,177,952 | 12/1979 | Rikker | 241/40 |
| 4,211,274 | 7/1980 | Slowinski et al. | 164/401 |
| 4,242,077 | 12/1980 | Hyre | 431/19 |
| 4,294,436 | 10/1981 | Takahashi | 266/257 |
| 4,340,433 | 7/1982 | Harding . | |
| 4,392,814 | 7/1983 | Harding | 431/170 |
| 4,411,709 | 10/1983 | Nakanishi . | |
| 4,415,444 | 11/1983 | Guptail | 209/3 |
| 4,427,375 | 1/1984 | Di Rosa | 432/58 |
| 4,457,352 | 7/1984 | Scheffer | 164/5 |
| 4,457,788 | 7/1984 | Staffin et al. . | |
| 4,478,572 | 10/1984 | Selli | 432/13 |
| 4,512,821 | 4/1985 | Staffin et al. . | |
| 4,519,718 | 5/1985 | Staffin et al. | 374/45 |
| 4,524,957 | 6/1985 | Staffin et al. | 266/252 |
| 4,544,013 | 10/1985 | Kearney et al. | 164/5 |
| 4,547,228 | 10/1985 | Girrell et al. . | |
| 4,563,151 | 1/1986 | Vogel | 432/15 |
| 4,577,671 | 3/1986 | Stephan | 164/401 |
| 4,579,319 | 4/1986 | Sasaki | 266/252 |
| 4,582,301 | 4/1986 | Wünning | 266/87 |
| 4,604,055 | 8/1986 | Mackenzie | 432/58 |
| 4,613,713 | 9/1986 | Staffin et al. | 585/241 |
| 4,620,586 | 11/1986 | Musschoot | 164/253 |
| 4,623,400 | 11/1986 | Japka et al. . | |
| 4,636,168 | 1/1987 | Sandstrom et al. | 432/58 |
| 4,648,836 | 3/1987 | Thom | 432/107 |
| 4,671,496 | 6/1987 | Girrell et al. | 266/78 |
| 4,700,766 | 10/1987 | Godderidge | 164/5 |
| 4,738,615 | 4/1988 | Bailey et al. | 432/15 |
| 4,779,163 | 10/1988 | Bickford et al. | 361/212 |
| 4,830,605 | 5/1989 | Hodate et al. | 431/170 |
| 4,955,425 | 9/1990 | McKenna | 164/269 |
| 4,957,431 | 9/1990 | Eng et al. | 432/31 |
| 5,018,707 | 5/1991 | Hemsath et al. | 266/254 |
| 5,169,913 | 12/1992 | Staffin et al. | 526/65 |
| 5,253,698 | 10/1993 | Keough et al. | 164/269 |
| 5,271,450 | 12/1993 | Bailey | 164/5 |
| 5,279,741 | 1/1994 | Schott | 210/634 |
| 5,294,094 | 3/1994 | Crafton et al. | 266/44 |
| 5,332,139 | 7/1994 | Heath et al. | 266/252 X |
| 5,350,160 | 9/1994 | Crafton et al. | 266/252 |
| 5,354,038 | 10/1994 | Crafton | 266/44 |
| 5,378,434 | 1/1995 | Staffin et al. | 422/141 |
| 5,423,370 | 6/1995 | Bonnemasou et al. | 164/132 |
| 5,439,045 | 8/1995 | Crafton | 164/5 |
| 5,531,423 | 7/1996 | Crafton et al. | 266/44 |
| 5,738,162 | 4/1998 | Crafton | 164/5 |
| 5,829,509 | 11/1998 | Crafton | 164/404 X |

FOREIGN PATENT DOCUMENTS

| | | | |
|---|---|---|---|
| 2 914 221 | 10/1980 | Germany . | |
| 4 012 158 | 11/1990 | Germany . | |
| 56-53867 | 5/1981 | Japan . | |
| 58-25860 | 2/1983 | Japan . | |
| 59-39464 | 3/1984 | Japan . | |
| 59-219410 | 12/1984 | Japan . | |
| 60-92040 | 5/1985 | Japan . | |
| 62-74022 | 4/1987 | Japan . | |
| 63-16853 | 1/1988 | Japan . | |
| 63-108941 | 5/1988 | Japan | 164/404 |
| 234 810 | 4/1969 | U.S.S.R. . | |
| 1 129 012 | 12/1984 | U.S.S.R. . | |
| 1125757 | 8/1968 | United Kingdom . | |
| 1 392 405 | 4/1975 | United Kingdom . | |
| 1 564 151 | 4/1980 | United Kingdom . | |
| 1 569 152 | 6/1980 | United Kingdom . | |
| 2 230 720 | 10/1990 | United Kingdom . | |
| WO 92/20478 | 11/1992 | WIPO . | |
| WO 94/04297 | 3/1994 | WIPO . | |
| WO 95/19860 | 7/1995 | WIPO . | |
| WO 97/30805 | 8/1997 | WIPO . | |

OTHER PUBLICATIONS

Sales Brochure Describing Thermfire Brand Sand Reclamation, Gudgeon Brothers, Ltd., Believed to be Known by Others Prior to Sep., 1989.

Sales Brochure Describing Simplicity/Richards Gas–Fired Thermal Reclamation System, Simplicity Engineering, Inc., Believed to be Known by Others Prior to Sep., 1989.

Sales Brochure Describing Air Trac Brand Fluidizing Conveyor, Air Trac Systems Corp., Believed to be Known By Others Prior to Sep., 1989.

Sales Brochure Describing Fluid Bed Clacifire Thermal Sand Reclamation Systems, Dependable Foundry Equipment Co., Inc., Believed to be Known by Others Prior to Sep., 1989.

Beardsley & Piper, Advertisement describing Beardsley & Piper PNEU–Reclaim Sand Reclamation Units (Dec., 1989).

Advertisement describing Fataluminium Sand Reclamation Units (Dec., 1989).

VIBRATORY SAND RECLAMATION SYSTEM

RELATED APPLICATION

This is a continuation of earlier filed, co-pending application Ser. No. 08/770,343, filed Dec. 20, 1996, now U.S. Pat. No. 5,924,473.

FIELD OF THE INVENTION

The present invention is generally related to the foundry industry and, more particularly, to a vibratory sand reclamation system for reclaiming foundry sand.

BACKGROUND OF THE INVENTION

As is well known in the art, vibratory processing equipment has been developed to satisfy a wide range of diverse applications. It is oftentimes the case that a system for handling any of a variety of different materials will include as an integral component a vibratory conveyor. Generally, vibratory conveyors may be used for transporting materials to and through a processing section to a post-processing location.

In one particular application, a vibratory conveyor may find advantageous use in a foundry for conveying metal castings or the like from one point to another after they have been formed. There is another very important need to be able to remove sand molds and sand cores and to thereafter reclaim and recirculate the foundry sand which is typically bonded by a resin to form the sand molds and to make the sand cores used in the molds to create interior voids during conventional production of metal castings. After metal castings have been formed, the sand molds and sand cores must be removed, following which the sand must be reclaimed which has typically been accomplished by using a machine called a shake-out.

In this connection, the shake-out is typically of a vibratory nature and operates such that the moisture and clay bonded type sand is simply shaken loose from the metal castings. Optionally, the sand molds and sand cores using resin bonded type sand may be subjected to hot air for the purpose of causing the resin binder in the sand to break down so that the sand will fall away from the metal castings and core passages. In either case, the sand will typically be collected in the bottom of a chamber for further heat or chemical processing to remove any remaining resin to thereby reclaim the sand which is stored for later reuse.

As shown by Nakanishi, U.S. Pat. No. 4,411,709, it has been known that resin bonded sand molds and sand cores can be removed, and the sand simultaneously reconditioned for re-use, by heating the resin bonded molding sand and core sand at a sufficient temperature to be able to pyrolyze the resin binders in the sand. As explained in Crafton, U.S. Pat. No. 5,354,038, and later in Bonnemasou et al., U.S. Pat. No. 5,423,370, it may be advantageous for this heating to be accomplished by utilizing a fluidized bed of sand particles. In particular, Bonnemasou et al. U.S. Pat. No. 5,423,370 point outs that fluidized beds are useful for removing the sand cores from cast aluminum parts, but it also cautions that, when hot, these cast aluminum parts are such that they cannot tolerate "even modest handling."

Moreover, while it is known to use heat to reclaim the sand by pyrolyzing the resin bonding material, this poses a seemingly unresolvable dilemma; namely, how to apply sufficient heat for efficient pyrolyzing of the bonding material in a manner achieving significant energy conservation.

The present invention is directed to overcoming one or more of the foregoing problems while achieving one or more of the resulting objects by providing a unique vibratory sand reclamation system.

SUMMARY OF THE INVENTION

It is an object of the present invention to provide an apparatus and system for removing resin bonded sand in the form of a sand mold and/or sand core from a metal casting in order to reclaim the sand for further use. It is also an object of the invention to provide such an apparatus and system having a fluidized bed through which hot castings are moved by vibratory forces to thereby remove sand by the combined action of vibratory forces, heated and fluidized sand, and the movement of the hot castings through the sand. It is a further object of the present invention to provide the vibratory conveying fluidized bed as an intermediate section of a vibratory conveyor fed with reclaimed and recirculated hot sand in a continuous conveying system.

Accordingly, the present invention is directed to an apparatus and system for removing and reclaiming sand from metal casting molds. The apparatus and system includes a fluidized bed together with means for vibrating the bed to move castings from a casting entrance for receiving the castings to a casting exit for removing the castings. Means are provided for supplying hot sand to the fluidized bed at a point generally near the casting entrance and means are also provided for removing reclaimed hot sand from the fluidized bed to be recirculated from a point generally near the casting exit. The apparatus and system also includes means for recirculating hot sand from the sand removing means to the sand supplying means where it is again fluidized. Further, the apparatus and system includes means for diverting excess sand therefrom, preferably in the form of an overburden chute having a lower edge defining a weir at a preselected level.

In an exemplary embodiment, the system comprises a heated chamber for removing and reclaiming sand, a plenum for providing hot air to the heated chamber, and a grid-like casting support surface separating the heated chamber from the plenum. The system also advantageously contemplates the casting support surface being formed to have a plurality of dividers forming a plurality of casting conveying lanes extending longitudinally through the system. Preferably, a continuous uninterrupted vibrated casting support surface defines a continuous conveying path leading from a casting loading conveyor, to and through the fluidized bed, and then to a casting exit conveyor.

As a perhaps superior alternative to utilizing dividers to form multiple casting conveying lanes, a pallet can be utilized in conjunction with a mechanical robot loading device for supporting a plurality of sand molds each containing a metal casting. The pallets for the metal castings advantageously have a plurality of casting supporting bins. Preferably, the casting supporting bins of each of the pallets permits the hot air from the plenum to pass into the fluidizing section where it fluidizes and heats sand in the fluidized bed.

In a highly preferred embodiment, the sand supplying means comprises a sand distribution conveyor having a sand distribution aperture disposed above the casting loading conveyor upstream of the casting entrance to the fluidized bed. The sand removing means also advantageously comprises a sand transfer conveyor communicating with a sand removal chute which is preferably disposed generally at a point below the casting exit conveyor at a point downstream of the casting exit to the fluidized bed. Still additionally, the sand recirculating means preferably comprises a sand return conveyor extending from the sand distribution conveyor to the sand transfer conveyor to recirculate sand to be fluidized and heated in the fluidized bed.

In a most highly preferred embodiment, the apparatus and system includes a casting entrance seal hinged from above the entrance of the fluidized bed and also includes a casting exit seal hinged from above the exit of the fluidized bed where the seals serve to conserve energy by retaining heat within the fluidized bed. Additionally, the sand distribution conveyor, sand transfer conveyor, and sand return conveyor are all most advantageously portions of an integral enclosed and insulated continuous vibratory conveying system for recirculating hot sand through the fluidized bed with much improved and efficient heat transfer characteristics.

In an alternative embodiment, a plurality of hot gas distribution ducts and hot gas permeable pallets that support the sand molds containing the metal castings are provided whereby the pallets are conveyed through the fluidized bed while supported on at least a pair of rails carried by and connected to upper surfaces of the hot gas distribution ducts.

In the alternative embodiment, the hot gas distribution ducts each preferably entirely span the width of the fluidized bed and have perforated lower surfaces in spaced relation to a bottom surface of the heated chamber. This permits hot gas to be directed into sand that surrounds the distribution ducts. The hot gas will first be directed downwardly, will next penetrate upwardly through the sand between the hot gas distribution ducts and through the pallets causing all of the loose sand to be fluidized.

Other objects, advantages and features of the present invention will become apparent from a consideration of the following specification taken in conjunction with the accompanying drawings.

BRIEF DESCRIPTION OF THE DRAWINGS

FIG. 3 is an elevational cross-sectional view taken generally along the lines 5—5 of FIG. 1;

DETAILED DESCRIPTION OF THE PREFERRED EMBODIMENT

Figure 1:
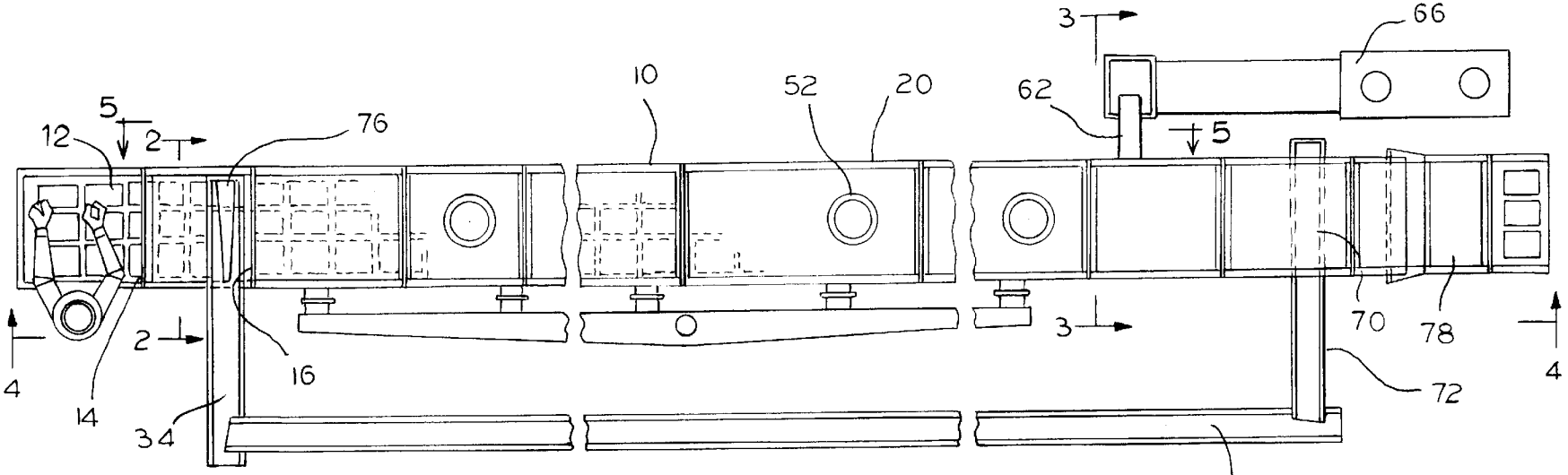
FIG. 1 is a plan view of an apparatus and system for removing, reclaiming and recirculating sand from a metal casting according to the present invention.
Figure 4:
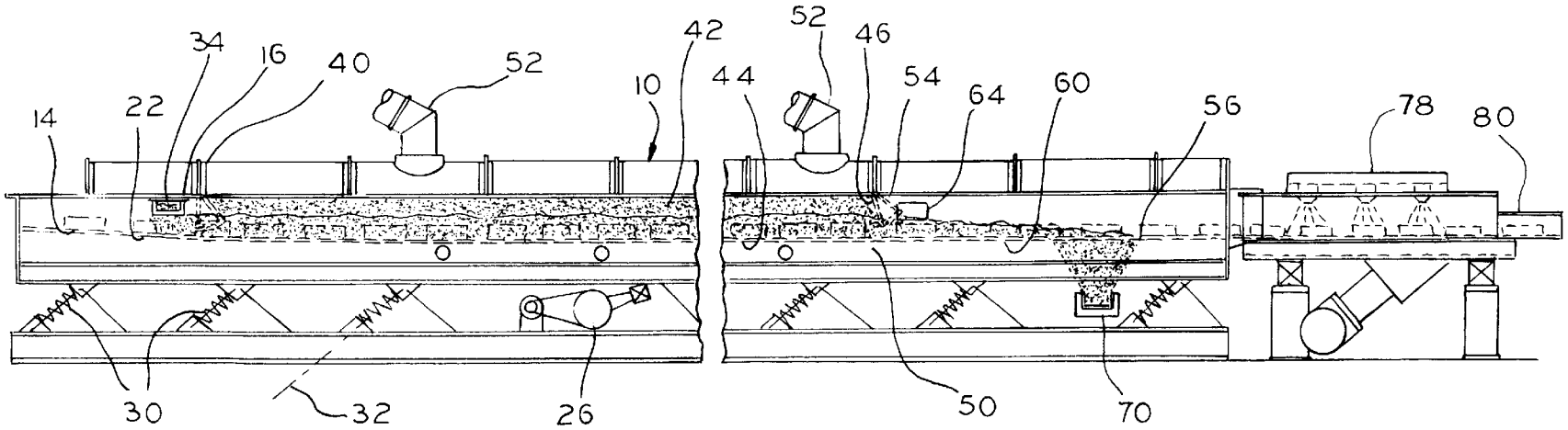
FIG. 4 is an elevational cross-sectional view taken generally along the lines 4—4 of FIG. 1.

In the illustrations given herein, and with particular reference first to FIGS. 1 and 4, the reference number 10 will be understood to designate generally an apparatus and system for removing and reclaiming sand from a metal casting in accordance with the teachings of the present invention. As shown in FIG. 1, the apparatus 10 is utilized to process metal castings such as 12, each having its sand mold and sand cores still in place as it follows a continuous, vibrated path extending from a casting loading conveyor 14 to a casting entrance 16 of a fluidized bed 20 where the processing takes place.

Figure 2:
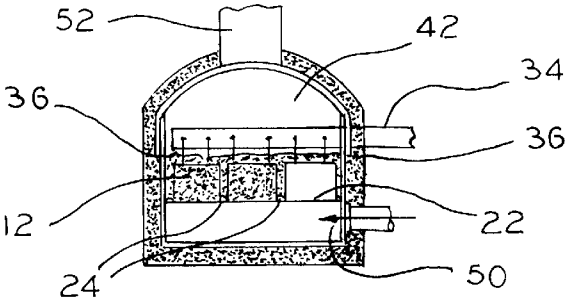
FIG. 2 is an elevational cross-sectional view taken generally along the lines 2—2 of FIG. 1.

More specifically, the casting loading conveyor 14 has a casting support surface or floor 22 that is wide enough to accommodate at least one metal casting 12, and is preferably wide enough to accommodate a plurality of metal castings 12 in generally side-by-side fashion (see, e.g., FIG. 2). As clearly illustrated in FIG. 2, the casting support surface or floor 22 may advantageously be formed so as to have a plurality of dividers 24 that extend longitudinally along the casting loading conveyor 14 so as to form a plurality of casting conveying lanes along which the metal castings 12 may move.

Referring now to FIG. 4, the casting support surface or floor 22 is vibrated by an unbalanced motor or eccentric drive 26 and associated spring and rocker arm assemblies 30 to produce vibratory forces acting generally along oblique axes such as 32. In this manner, the vibratory forces cause each of the sand molds containing the metal castings 12 to be conveyed along their respective conveying lanes toward the fluidized bed 20 for pyrolyzing the sand molds and sand cores to reclaim the sand.

Figure 6:
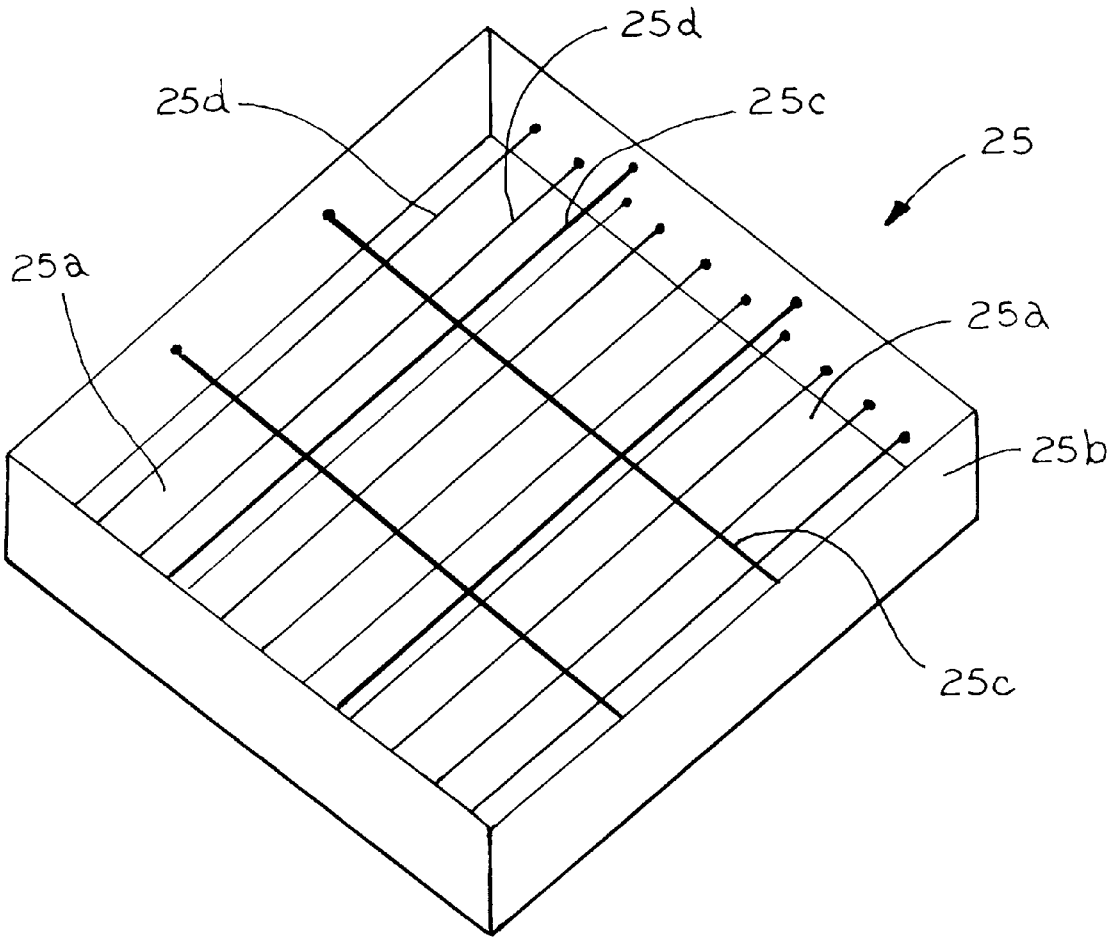
FIG. 6 is a perspective view of a pallet for supporting a plurality of metal castings as they are conveyed through the apparatus and system of FIG. 1.

Alternately, as a perhaps superior alternative, several metal castings 12 may be positioned on each of a plurality of open frame pallets 25 which can be conveyed on the casting support surface or floor 22. The pallets 25 (see FIG. 6) for the metal castings 12 advantageously each have a plurality of casting supporting bins 25*a* which may be defined by a square or rectangular side frame 25*b* and a plurality of rods 25*c* for dividing the pallet into the bins 25*a*, and the pallets 25 also may have a plurality of rods 25*d* for supporting the castings therein. In this manner, the casting supporting bins 25*a* of each of the pallets 25 is such as to permit hot air to pass through to fluidize sand in the fluidized bed 20 as will be described below.

Figure 5:
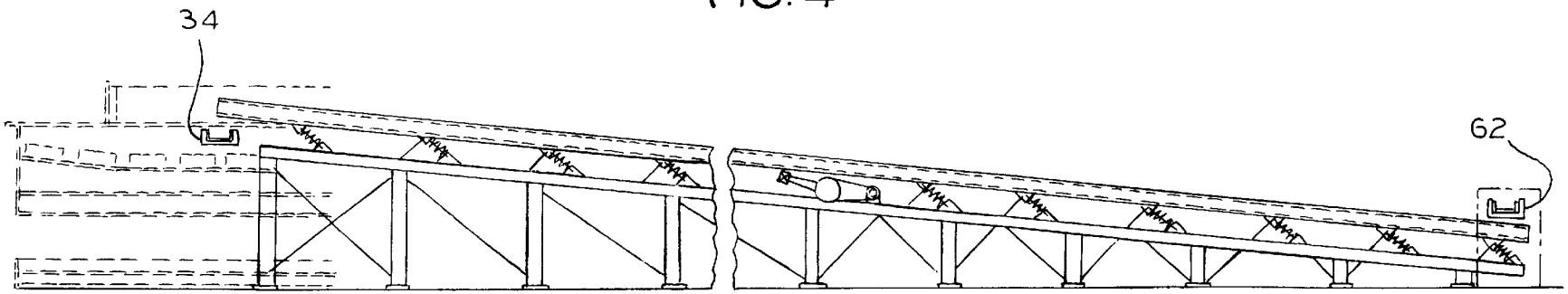

Before entering the fluidized bed 20, hot sand is poured onto the sand molds containing the metal castings 12 to cover them to thereby provide a supply of hot sand for fluidization. The hot sand is recirculated sand poured from a sand distribution conveyor 34 that will be seen to overlie the casting loading conveyor 14 (see FIGS. 4 and 5). Referring specifically to FIG. 2, the side walls 36 on the casting loading conveyor 14 will be understood to prevent this hot sand from spilling laterally as it is conveyed toward the fluidized bed 20.

Once the hot sand has been supplied to the loading conveyor 14, the sand molds containing the metal castings 12 will move with the sand into the fluidized bed 20 through the casting entrance 16. As this occurs, the sand molds containing the metal castings 12 and the sand bed which surrounds and covers them will push back a casting entrance seal 40 (see FIG. 4) that may be hinged from a point above the casting entrance 16 to the fluidized bed 20. As will be appreciated from the foregoing, the casting entrance seal 40 serves to help retain heat within the sand in the fluidized bed 20 as the metal castings 12 are conveyed therethrough.

Once the sand molds containing the metal castings 12 reach the fluidized bed 20, they will be understood to move quite slowly within a heated chamber 42 along another casting support surface or bed floor 44 from the casting entrance 16 to a casting exit 46. The casting support surface or bed floor 44 is preferably an uninterrupted continuation of the casting support surface or floor 22 of the loading conveyor 14, i.e., they advantageously comprise a single, continuous and uninterrupted vibrated surface. Thus, the casting support surfaces or floors 22 and 44 may be supported by the same associated spring and rocker arm assemblies and vibrated by the same unbalanced motor or eccentric drive 26 to produce vibratory forces generally along oblique axes such as 32.

Heated air at a temperature of 800–1000° F. is produced in a hot air supply furnace (not shown) and is fed to a convector plenum 50 that extends below and substantially entirely along the casting support surface or floor 44. As will be recognized by those skilled in the art, the heated air fed to the plenum 50 is forced through suitable openings through and substantially entirely along the casting support surface or floor 44 into the sand bed surrounding the sand molds containing the metal castings 12 to thereby fluidize and further heat the sand in the fluidized bed 20 and pyrolyze the resin bonding material. As will also be recognized by those skilled in the art, the extent of fluidization can be varied at different points along the fluidized bed 20, if desired, by altering the temperature of the air and/or the volume of air entering the sand, e.g., by varying the size of the air openings. Since the metal castings 12 move quite slowly through the fluidized bed 20, it may prove useful to control the extent of fluidization at different points therealong.

Figure 7:
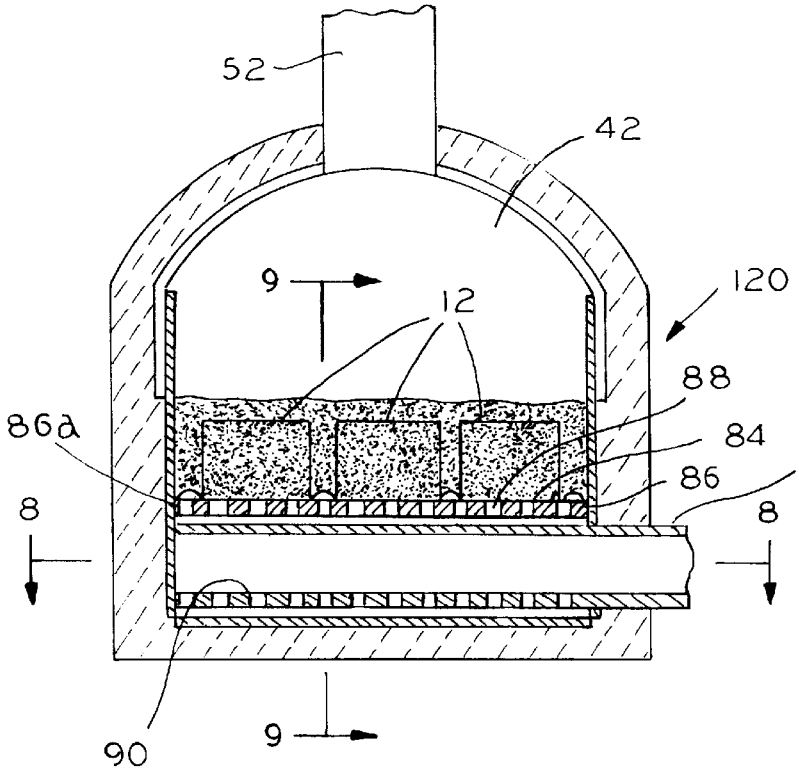
FIG. 7 is an elevational cross-sectional view similar to FIG. 2 illustrating an alternative embodiment.
Figure 8:
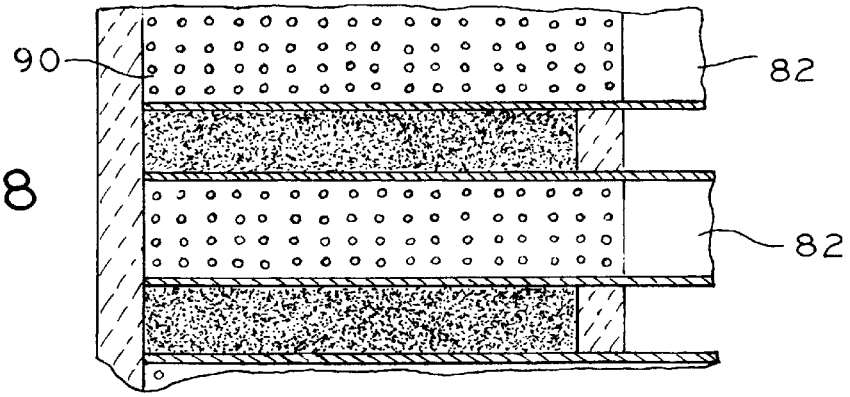
FIG. 8 is an elevational cross-sectional view taken generally along the lines 8—8 of FIG. 7.
Figure 9:
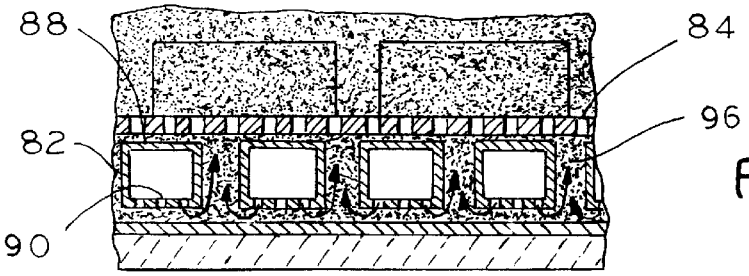
FIG. 9 is an elevational cross-sectional view taken generally along the lines 9—9 of FIG. 7.

Referring to FIGS. 7–9, an alternative embodiment of a fluidized bed 120 has been illustrated for use with the remainder of the apparatus and system 10 for removing and reclaiming sand from a metal casting in accordance with the teachings of the present invention. The casting supporting surface or floor 22 and convector plenum 50 of the embodiment of fluidized bed 20 best illustrated in FIG. 2 have been replaced by a plurality of hot air distribution ducts 82 and hot air permeable pallets 84 that support the sand molds containing the metal castings 12. With this alternative construction, the pallets 84 are conveyed through the fluidized bed 120 while supported on at least a pair of rails 86*a* and 86*b* carried by and connected to the upper surfaces 88 of the hot air distribution ducts 82 thereby eliminating the need for the casting supporting surface or floor 24.

More specifically, it will be seen that the hot air distribution ducts 82 each entirely span the width of the fluidized bed 120 and may advantageously be generally rectangular in cross-section (see FIG. 9). The hot air distribution ducts 82 also have perforated lower surfaces 90 in spaced relation to the bottom surface 92 of the heated chamber 42 within the fluidized bed 120 (see FIG. 8) to permit the hot air to be directed into the sand 96 that surrounds the distribution ducts generally as shown by the arrows in FIG. 9. The hot air will first be directed downwardly, will next penetrate upwardly through the sand 96 between the hot air distribution ducts 82 and through the pallets 84 causing all of the loose sand 96 to be fluidized including that which surrounds the sand molds containing the metal castings 12 that are being carried on the pallets 84.

As will be appreciated by those skilled in the art, the actual size and structure of the hot air distribution ducts 82, the degree and size of perforation of the lower surfaces 90, the longitudinal spacing between adjacent ones of the hot air distribution ducts 82, and other such parameters will be within the ability of those of ordinary skill who now will have a complete understanding of the inventive concept of the alternative embodiment illustrated in FIGS. 7–9.

As the sand molds containing the metal castings 12 move through the heated chamber 42, the binder in the sand molds and sand cores pyrolyzes, the pyrolyzed binder is vented from the fluidized bed 20 through vent stacks 52 at the top of the furnace 42, and the reclaimed sand from the molds and cores mixes with the fluidized sand about the metal castings 12 supported on and conveyed along the casting support surface or floor 44.

As will be appreciated, the unbalanced motor or eccentric drive 26 is utilized to move the sand molds containing the metal castings 12 through the fluidized bed 20 at different speeds. This may be desired to vary the actual time of metallurgical treatment of the castings as well as sand reclaiming treatment within the bed which may, by way of example, be on the order of two hours to ensure proper casting formation as well as fully removing the sand molds and sand cores from the castings and reclaiming the sand. The long residence time may be achieved by utilizing a first, lower motor or drive speed in which the horizontal component of vibratory force is not sufficient to overcome friction and other resistance to forward movement of the casting-conveying pallets or castings through the fluidized bed 20. The treatment period may be followed by utilizing a second, higher motor or drive speed to increase the horizontal component of vibratory force to overcome the resistance to forward movement to thereby move the castings on through the fluidized bed 20. This provides significant advantages since in the first, lower motor or drive speed the vertical component of vibratory force significantly enhances fluidization of the sand in comparison with an entirely static fluidized bed through which the castings may be pulled while nevertheless accommodating the desired long residence time. As will be appreciated, the speed of moving the sand molds containing the metal castings 12 may be varied by changing the vibratory force or revolutions per minute produced by the unbalanced motor or eccentric drive 26.

As the metal castings 12 and loose sand exit the fluidized bed 20 though the casting exit 46, they push back a casting exit seal 54. The casting exit seal 54 is preferably hinged from above the casting exit 46 and, like the casting entrance seal 40, helps retain heat within the sand in the fluidized bed 20. The castings 12 and loose molding sand (including that from the sand cores) reclaimed by heating to pyrolyze the binder moves through the casting exit seal 54 to a casting exit conveyor 56 along with the sand originally supplied by the sand distribution conveyor 34. The casting exit conveyor 56 has a casting support surface or floor 60 that is preferably an uninterrupted continuation of the casting support surface or floor 44 of the fluidized bed 20. In other words, all of the casting support surfaces or floors 22, 44 and 60 advantageously comprise a single, continuous and uninterrupted vibrated surface.

Figure 3:
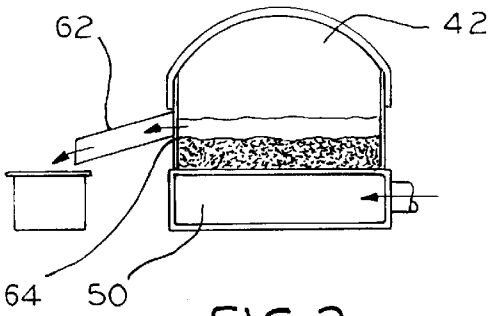
FIG. 3 is an elevational cross-sectional view taken generally along the lines 3—3 of FIG. 1.

As discussed in connection with the casting support surfaces or floors 22 and 44, the casting support surface or floor 60 may be supported by the same associated spring and rocker arm assemblies and vibrated by the same unbalanced motor or eccentric drive 26 to produce vibratory conveying forces along generally oblique axes such as 32. The vibration of the casting exit conveyor 56 will be understood to convey the metal castings 12 as well as the loose sand (including that which has been reclaimed) away from the fluidized bed 20. As seen in FIG. 3, a portion of the loose sand which is preferably approximately equal to the volume of the sand that was present in the sand cores and/or in the sand on the exterior of the metal castings 12 as the sand mold, is suitably removed by an overburden chute 62. The overburden chute 62 suitably extends from a side of the casting exit conveyor 56 and has a lower edge 64 set to serve as a sand weir at a preselected level in order to cause the appropriate amount of sand to be removed. As the metal castings 12 move past the overburden chute 62, the excess sand which has resulted from removing the sand cores and/or sand molds automatically spills out through the overburden chute 62 and is carried to a sand cooler 66, where it is cooled and stored for re-use in making new sand cores and/or sand molds for new metal castings.

After passing the overburden chute 62, the metal castings 12 and the remaining hot sand (including that which has been reclaimed) continues to move away from the fluidized bed 20 on the castings exit conveyor 56. The remaining hot sand falls away from the metal castings 12 through apertures or one or more slots (not shown) in the casting support surface or floor 60 of the exit conveyor 56 directly above a sand removal chute 70. A transfer conveyor 72 conveys the hot sand collected in the sand removal chute to a return conveyor 74, which in turn returns the sand to the sand distribution conveyor 34. The sand distribution conveyor 34 extends generally transversely of the castings loading conveyor 14, and has a distribution aperture 76 that begins above a near side of the casting loading conveyor 14 and widens toward the far side thereof. Accordingly, as the hot sand is being conveyed along the sand distribution conveyor 34, it falls through the distribution aperture 76 onto the next metal castings 12 being conveyed on the castings loading conveyor 14.

Obviously, the sand transfer conveyor 72, the sand return conveyor 74, and the sand distribution conveyor 34 may all advantageously be portions of a single enclosed and insulated continuous conveying system. This entire conveying system is preferably of the vibratory type described herein, although it will be understood that one or more portions of the conveying system could take the form of other conventional forms of conveyors. In any event, it is important to recognize that the recirculation of hot sand through the insulated continuous conveying system significantly increases the efficiency of the system by conserving on energy required to heat the sand.

With regard to the metal castings 12, the casting exit conveyor 56 continues to transport them even after the hot sand has been removed for recirculation through the sand removal chute 70. The metal castings 12 will typically be conveyed by the castings exit conveyor 56, either individually in conveying lanes such as previously described or on a pallet such as 25, to a quenching bath 78 for a conventional casting chilling process. During the chilling of the metal castings 12, they may be transported by any conventional means including a vibratory conveyor of the type described to a pick-off station 80 where they can be retrieved.

When utilizing a pallet 25, a robot may place a selected number of sand molds containing metal castings 12 in predetermined locations. These locations are known and correspond to where the casting supporting bins 25*a* are positioned in the pallet 25. Thereafter, when processing is complete, another robot may remove the metal castings 12 from the pallet 25 since their locations will not have changed.

With the present invention, it has become possible to exclusively utilize vibratory conveying means rather than roller conveyors. This holds true not only for conveying the metal castings during removal and reclamation of sand but also for the recirculation of sand. Moreover, this is done by producing a constantly circulating supply of hot sand to immediately cover the sand molds containing the hot metal castings 12.

By recirculating the hot sand through an insulated conveying system, it is possible to reduce the cost of energy that is required to pyrolyze the binder in the sand molds and sand cores since it is not necessary to entirely reheat recirculated sand. It is also noteworthy that the vibratory conveying of the metal castings through fluidized sand helps to produce a uniform temperature in the sand within the fluidized bed 20. In particular, this result is enhanced by the vertical force component of the vibratory conveying motion imparted to the castings in the system shown, even in the first, lower motor or drive speed, as the castings are conveyed through the fluidized bed 20. More specifically, the vertical force component caused by the vibratory movement serves to multiply the effect of fluidization by creating an even more thorough mixing of the hot air with the hot sand, the hot sand with itself, and contact of the hot sand with the sand mold, sand core and casting during the sand reclamation process.

By reason of the present invention, the uniformity of heat in the conveying sand and, thus, heat transfer efficiency has been maximized in an apparatus and system having truly unique attributes in relation to any apparatus and system heretofore known.

While in the foregoing there has been set forth a preferred embodiment of the invention, it will be appreciated that the details herein given may be varied by those skilled in the art without departing from the true scope and spirit of the appended claims.

We claim:

1. An apparatus for removing and reclaiming sand from metal castings, comprising:

means defining a casting entrance for receiving castings and a casting exit for removing castings;

means forming a bed for sand and means for supplying sand to said bed near said casting entrance thereof;

means for directing a hot gas through said sand in said bed to thereby heat and fluidize said sand; and means for removing said sand from said bed near said casting exit for recirculation to said casting entrance.

2. The apparatus of claim 1 wherein said means forming said bed comprises a heated chamber having a bottom surface for supporting said sand.

3. The apparatus of claim 2 wherein said means for directing said hot gas through said sand includes a plurality of hot gas distribution ducts.

4. The apparatus of claim 3 wherein each of said hot gas distribution ducts spans the width of said bed in longitudinally spaced relation therealong.

5. The apparatus of claim 4 wherein each of said hot gas distribution ducts is generally rectangular in cross-section having upper and lower surfaces.

6. The apparatus of claim 5 including a hot gas permeable pallet for supporting sand molds containing said metal castings on rails carried by said upper surfaces of said ducts.

7. The apparatus of claim 6 including means for vibrating said bed to convey said pallet on said rails from said casting entrance to said casting exit.

8. The apparatus of claim 4 wherein each of said ducts has a perforated lower surface disposed in spaced relation to said bottom surface of said heated chamber.

9. An apparatus for removing and reclaiming sand from a metal casting comprising:

a fluidized conveyor bed having a casting entrance for receiving said casting and a casting exit for removing said casting;

a casting loading conveyor leading to said casting entrance of said fluidized conveyor bed for conveying said casting thereto;

a sand distribution conveyor for supplying sand to be recirculated through said fluidized conveyor bed, said sand distribution conveyor having a sand distribution aperture positioned at a point generally above said casting loading conveyor, said sand distribution aperture being disposed upstream of said casting entrance of said fluidized conveyor bed;

means for heating and fluidizing sand in said fluidized conveyor bed by directing hot gas therethrough including a plurality of longitudinally spaced hot gas distribution ducts spanning the width of said fluidized conveyor bed;

a casting exit conveyor leading from said casting exit of said fluidized conveyor bed for conveying said casting therefrom;

a sand transfer conveyor communicating with a sand removal chute positioned at a point generally be low said casting exit conveyor;

an overburden chute extending from a side of said casting exit conveyor near said casting exit of said fluidized conveyor bed; and a sand return conveyor extending from said sand transfer conveyor to said sand distribution conveyor to recirculate sand thereby.

10. The apparatus of claim 9 wherein said sand distribution conveyor extends generally transversely of said casting loading conveyor and said sand distribution aperture widens from a near side toward a far side of said casting loading conveyor.

11. The apparatus of claim 9 wherein said overburden chute has a lower edge defining a sand weir at a preselected level to accommodate removal of excess sand created by removing sand from said metal casting in said fluidized conveyor bed.

12. The apparatus of claim 9 including a casting entrance seal hinged from a point above said casting entrance of said fluidized conveyor bed and also including a casting exit seal hinged from a point above said casting exit of said fluidized conveyor bed.

13. The apparatus of claim 9 wherein each of said hot gas distribution ducts is generally rectangular in cross-section having upper and lower surfaces.

14. The apparatus of claim 9 including a hot gas permeable pallet for supporting a sand mold containing said metal casting on rails carried by said upper surfaces of said ducts.

15. The apparatus of claim 14 including means for vibrating said fluidized conveyor bed to convey said metal casting on said pallet from said casting entrance to said casting exit on at least a pair of rails supported on said upper surfaces of said ducts.

16. The apparatus of claim 9 wherein each of said ducts has a perforated lower surface disposed in spaced relation to a bottom surface of a heated chamber defined by said fluidized conveyor bed.

* * * * *

UNITED STATES PATENT AND TRADEMARK OFFICE

CERTIFICATE OF CORRECTION

PATENT NO. : 5,967,222
DATED : October 19, 1999
INVENTOR(S) : Albert Musschoot and Daniel T. Lease It is certified that error appears in the above-identified patent and that said Letters Patent is hereby corrected as shown below:

Title page,
Item [63], please delete "Continuation" and insert -- Continuation-in-Part -- therefor.

Column 1,
Line 5, please delete "continuation" and insert -- continuation-in-part -- therefor.

Signed and Sealed this

Eleventh Day of March, 2003

JAMES E. ROGAN
*Director of the United States Patent and Trademark Office*